United States Patent [19]

Bills et al.

[11] Patent Number: 4,636,680

[45] Date of Patent: Jan. 13, 1987

[54] VACUUM GAUGE

[75] Inventors: Daniel G. Bills; Paul C. Arnold; Stephen L. Dodgen; Craig B. Van Cleve, all of Boulder, Colo.

[73] Assignee: Granville-Phillips Company, Boulder, Colo.

[21] Appl. No.: 497,581

[22] Filed: May 24, 1983

[51] Int. Cl.[4] ..... A47B 5/00

[52] U.S. Cl. ..... 313/7; 313/230; 313/264

[58] Field of Search ..... 324/462; 313/264, 616, 313/7, 230; 315/111.91

[56] References Cited

U.S. PATENT DOCUMENTS

| | | | |
|---|---|---|---|
| 2,605,431 | 7/1952 | Bayard | 313/7 |
| 2,605,432 | 7/1952 | Smith | 313/38 |
| 3,388,290 | 6/1968 | Herb et al. | 313/7 |
| 3,742,343 | 6/1973 | Pittaway | 324/33 |
| 3,743,876 | 7/1973 | Redhead | 324/462 |
| 3,839,655 | 10/1974 | Helgeland et al. | 313/7 |
| 4,307,323 | 12/1981 | Bills et al. | 315/111.91 |

OTHER PUBLICATIONS

*Journal of the Vacuum Society of Japan,* vol. 19, No. 7, 1976, pp. 9–16.

K. E. McCulloch & C. R. Tilford, "Nitrogen Sensitivities of a Sample of Commercial Hot Cathode Ionization Gage Tubes", J. Vac. Sci. Technol., 18(3), Apr. 1981.

C. R. Tilford & K. E. McCulloh, "Performance Characteristics of a Broad Range Ionization Gage Tube", J. Vac. Sci. Technol., 20(4), Apr. 1982.

Charles R. Tilford, "Reliability of High Vacuum Measurements", J. Vac. Sci. Technol., A1(2), Apr.–Jun. 1983.

D. McComas & S. J. Bame, Rev. Sci. Instrum. 53 1490 (1982).

P. A. Redhead, "The Sensitivity of Bayard–Alpert Gauges", J. Vac. Sci. Technol. 6, 848 (1969).

P. S. Choumoff & B. Iapteff, Proc. 6th Internl. Vacuum Congr. 1974, Japan. J. Appl. Phys. Suppl. 2, Pt. 1, 1974.

A. Klopfer, Trans. AVS Vac. Symp. 8 439 (1961b).

A. Klopfer & W. Schmidt, Vacuum 10 363 (1960).

D. Alpert & R. S. Buritz, J. Appl. Phys. 25 202 (1954).

G. E. Mass Spectrometer Data Sheet GEI–76963.

CEC Data Sheet, Type 24–120B.

Poulter and Sutton, "Long Term Behaviour of Ionization Gauges", Vacuum 31 147 (1981).

Poulter et al, "Intercomparison of Vacuum Standards of Countries Within the European Community in the Range $8\times10^{-5}$ to $8\times10^{-2}$ Pa", *J. Vac. Sci. Technol. 17 679 (1980).*

Pittaway, "Electron Trajectories in Ionization Gauges", *J. Phys. D: Appl. Phys.* 3 173 (1966).

Redhead, "The Sensitivity of Bayard–Alpert Gauges", *J. Vac. Sci. Technol.* 6 848 (1969).

Ohsako, "New Wide–Range B–A Gauge from UHV to $10^{-1}$ Torr", *J. Vac. Sci. Technol.* 20 1153 (1982).

Redhead, "New Hot–Filament Ionization Gauge with Los Residual Current", *J. Vac. Sci. Technol.* 3 173 (1966).

*Primary Examiner*—David K. Moore

*Attorney, Agent, or Firm*—Gerald J. Ferguson, Jr.; James E. Bryan; Michael P. Hoffman

[57] ABSTRACT

An ionization gauge of the type including a source of electrons, an accelerating electrode for accelerating said electrons through a volume generally defined by said accelerating electrode and a collector electrode, disposed in the volume. Ions are collected by the collector electrode. The accelerating electrode comprises a substantially closed anode having an internal cavity to precisely define the volume. An aperture is disposed to admit said electrons from the source into the closed volume.

44 Claims, 12 Drawing Figures

VACUUM GAUGE

BACKGROUND OF THE INVENTION

The present invention relates to vacuum gauges and more particularly to ionization gauges for use over a wide pressure range.

Ionization gauges are, in general, known. Such gauges typically comprise a source of electrons (cathode), an accelerating electrode (anode) to provide energetic electrons, and a collecting electrode (collector) to collect the ions formed by electrons impacting on gas molecules or atoms within the gauge. The number of positive ions formed within the gauge (in a gas susceptible to ionization by electron impact) is directly proportional to the molecular concentration of gas within the gauge. However, the production of undesirable extraneous currents in the gauge, which are independent of gas pressure, tend to present a practical barrier to measurement of ultra-high vacuums.

The undesirable extraneous currents principally result from a so-called X-ray effect. Bombardment of the anode by electrons produces soft X-rays. The soft X-rays impinge on the collector, thereby producing a photo-electron current which adds to the ion current in the collector. The photo-electron current and the ion current are not distinguishable from one another in the ion current measuring circuit. Thus, the photo-electron current establishes a lowest practical limit beyond which meaningful ion current measurement cannot be had.

In general, vacuum gauges which have successfully reduced the X-ray effect by several orders of magnitude and permitted pressure measurement to at least $10^{-10}$ Torr and with special precautions to still lower pressures are known. Such a gauge, commonly referred to as the "Bayard-alpert (BA) gauge," is disclosed in U.S. Pat. No. 2,605,431 issued July 29, 1952 to Bayard. See also U.S. Pat. No. 4,307,323 issued on Dec. 22, 1981 to Bills et al. The BA ionization gauge is widely used. However, because low pressure gauge calibration is a very expensive and time-consuming procedure, most BA transducers are used as manufactured, and are typically not subjected to calibration before use. Thus, it is highly desirable that the gauge sensitivity be highly reproducible and stable with use.

Unfortunately, the sensitivity of commercially available BA gauges tends to be neither reproducible, nor stable. It has been found that typical commercially available BA gauges exhibit substantial differences in sensitivity from the nominal value of sensitivity specified by the manufacturer. See K. E. McCulloh and C. R. Tilford, *J. Vac. Sci. Technol.* 18 994 (1981). It has also been found that sensitivity in the same gauge assembly tends to differ when operation is switched from one filament to another. Further, it has been noted that the sensitivity of typical BA gauges tends to drift by, for example, as much as −1.4% per 100 operating hours when kept at vacuum. Moreover, changes in sensitivity (of up to 25%) occur when the gauge is briefly exposed to the atmosphere and then operated in vacuum. See K. F. Poulter and C. M. Sutton, *Vacuum* 31 147 (1981).

Ionization gauges have been made which exhibit sensitivities which are reproducible and stable to better than ±2% over an 18-month period. However, these transducers are elaborate, complex and costly devices not suited for general use and are incapable of measuring very low pressures. See K. F. Poulter et al, *J. Vac. Sci. Technol.* 17 679 (1980).

It has been determined that changes in a number of gauge parameters in particular tend to produce variations (from gauge to gauge and within the same gauge from use to use) in ion current for a given constant pressure and constant emission current: (a) the electron current effective to produce ions; (b) the ionizing energy; (c) the total electron path length; and/or (d) the ion collection efficiency.

The electric field in the prior art gauges varies from place to place in the gauge. Accordingly, the ionizing energy that an electron acquires depends both upon the particular trajectory of the electron and the instantaneous position of the electron along the trajectory. However, it is well-known that electrons emitted from different portions of the cathode follow greatly different trajectories in a BA gauge. Electron paths vary greatly depending on where on the cathode and in which direction the electron is emitted. See, for example, L. G. Pittaway, *J. Phys. D. Appl. Phys.* 3 1113 (1970).

Free-standing electrodes are commonly used in ionization gauges. Examples are described in U.S. Pat. Nos. 3,742,343 issued June 26, 1978 to Pittaway, and 3,839,655 issued Oct. 1, 1974 to Helgeland et al, and in P. A. Redhead, *J. Vac. Sci. Technol.*, 3 173 (1966). Such electrode structures, however, are prone to creep and sag with use. It has been observed that seemingly negligible variations in electrode geometry in the prior art gauges, due to, for example, small manufacturing tolerances, or creep and sag of the electrode, produce large changes in number of electrons transmitted and drastically affect electron trajectories (and thus total electron path length) in the ion collection volume.

Since, in prior art devices, the trajectory of an electron is dependent upon point of origin on the cathode, if the pattern of emitted electrons from the cathode varies, the total electron path length and the ionizing effectiveness in the gauge will vary. Unfortunately, as is well-known, the emission pattern from a hot cathode is drastically affected by localized changes in the work function of the cathode surface due to contamination, by changes in the emissivity of the emitting surface, and by changes in the cathode temperature. For example, thoria coated refractory metal cathodes are commonly used in ionization gauges. Cracking and spalling of the coating from the refractory metal base can lead to relatively large localized temperature changes resulting in large changes in the emission pattern. Also, crystal formation in pure refractory metal cathodes can cause localized changes in work function which can drastically affect the emission pattern.

Attempts have been made to control the divergence of the emitted electron stream from the cathode to anode. For example, a special electrode has been placed behind the cathode for this purpose. Such a gauge is described in U.S. Pat. No. 3,743,876 to P. A. Redhead on July 3, 1973.

Additional reasons for the non-reproducible and unstable prior art gauge sensitivities have been noted. It is well-known in the art of electron tube devices that electrons are preferentially focused on grid wires held at a positive potential with respect to the cathode. Thus, the fraction of electrons transmitted through the grid in a BA gauge is substantially less than would be estimated from the geometrical transparency of the grid. Empirical observations show less than 50% of the incident electrons are transmitted through a grid with 85% geometrical transparency.

In addition, the ion collection volume in the prior art gauges tends to be neither reproducible nor stable. The ion collection volume is the volume, within the gauge anode within which a positive ion with zero initial velocity is attracted to and collected by the ion collector. In prior art gauges utilizing an open grid, such as a BA gauge, the electric field leaks through the open grid. Accordingly, ions formed near the grid experience an electric force urging them out of the grid volume, rather than an electric force urging them toward the ion collector. This leakage of the electric field into the grid volume considerably reduces the volume from which positive ions are collected by the ion collector. If the grid electrode in prior art gauges was entirely reproducible and remain stable with use, the decreased ion collection volume would merely result in decreased sensitivity. However, because the grids in the prior art gauges are purposely flimsy, the grids and, therefore, the gauge sensitivity, are neither reproducible nor stable.

Thus, prior art gauges tend not to have reproducible and stable gauge sensitivities. The emission pattern varies from cathode to cathode, and varies even in respect to an individual cathode with extended use and with exposure to air or oxygen. Thus, the electron trajectories change, producing changing path length and varying sensitivity. The use of grids and asymmetrical cathodes causes the gauges to be enormously sensitive to small variations in uncontrollable parameters. Emission patterns are essentially non-controllable, and manufacturing tolerances, creep and sag in the prior art gauges cannot be reduced economically.

SUMMARY OF THE INVENTION

The present invention provides a low-cost ionization gauge capable of accommodating both very high and very low pressures, which manifests a reproducible and stable sensitivity.

In accordance with one aspect of the present invention, the cathode and anode are disposed to provide substantially the same electrostatic field in respect of each electron emitted from the cathode at corresponding points in the respective trajectories of the electrons.

In accordance with another aspect of the present invention, all emitted electrons enter an ion collection volume from an emitter (cathode) disposed outside of the ion collection volume, and all electrons traverse the ion collection volume only once before being captured. The ion collection volume is a relatively large fraction of the anode volume, and is easily reproducible from gauge to gauge.

In accordance with another aspect of the present invention, the sensitivity of the gauge is essentially independent of changes in emission pattern of the cathode and expected variation in cathode position. The electron path length from the cathode to the electron collector, the electron path length in the ion collection volume, and the electron ionizing ability are independent of the point of origin of the electron on the cathode. Moreover, the gauge is not adversely affected by existing electric fields for energizing particles in the vacuum system.

In accordance with a further aspect of the present invention, electrons entering the ion collection volume exit the anode volume (in the absence of gas molecules) and are collected on a surface disposed outside of the anode volume and not visible from the ion collector. Thus, impingement of X-rays on the ion collector is essentially eliminated.

In accordance with still another aspect of the present invention, the gauge cathode is self-supporting in any mounting position, and automatically moves into a predetermined emitting position when heated.

BRIEF DESCRIPTION OF THE DRAWINGS

A preferred exemplary embodiment of the present invention will hereinafter be described with reference to the appended drawing, wherein like numerals denote like elements; and, FIG. 1 is a schematic cross section view of one embodiment of an ionization gauge in accordance with the present invention.

DETAILED DESCRIPTION OF A PREFERRED EXEMPLARY EMBODIMENT

Figure 1:
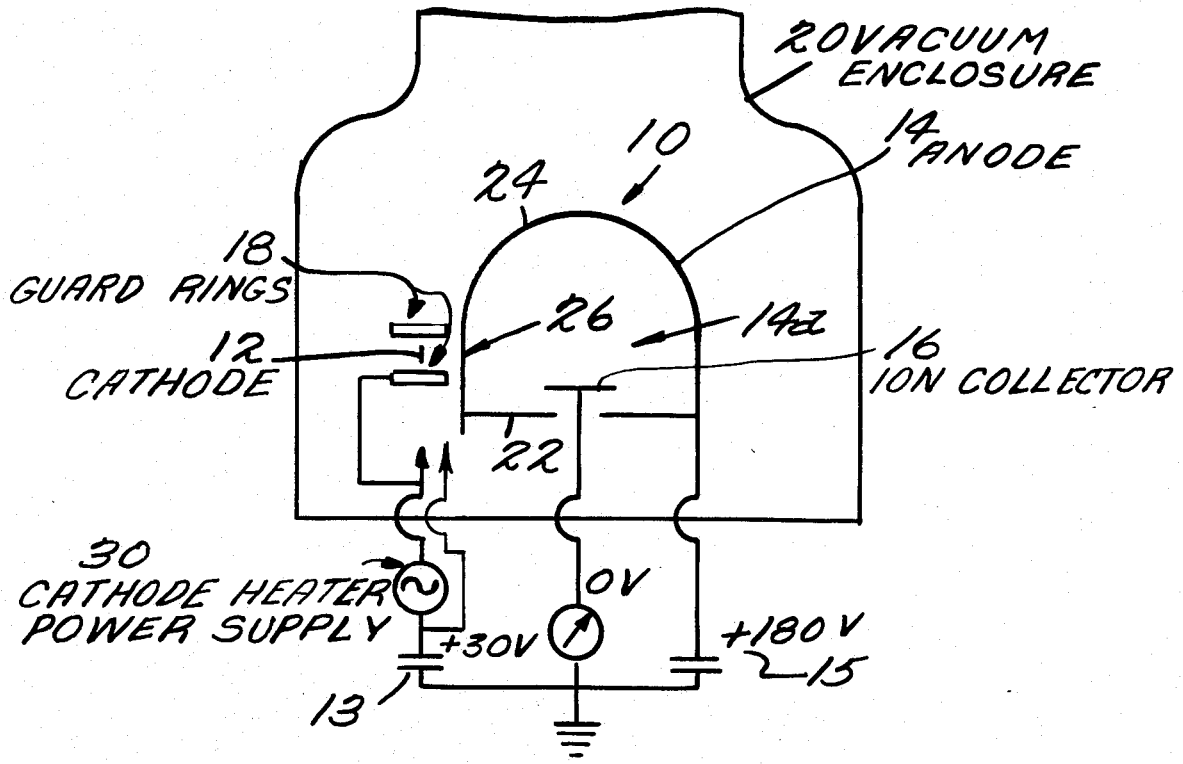
Figure 2:
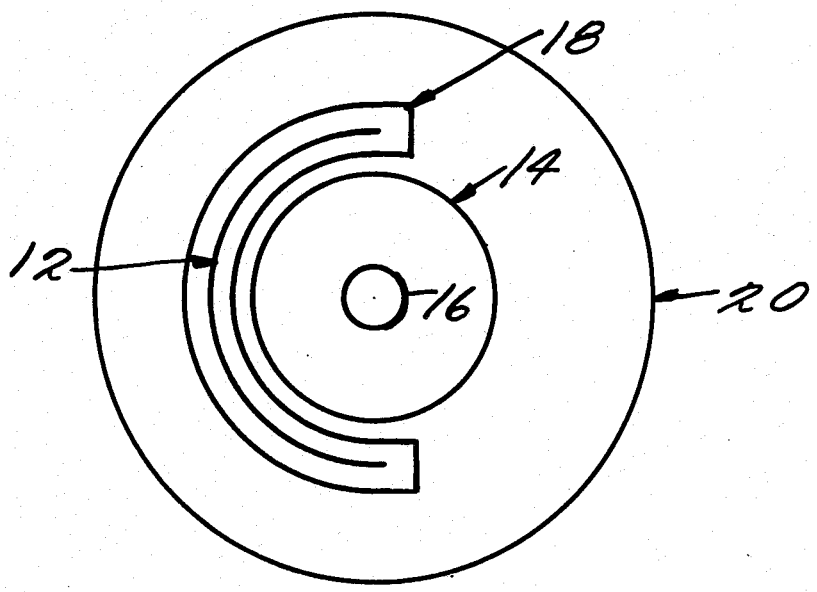
FIG. 2 is a top view of the gauge shown in FIG. 1.

Referring to FIGS. 1 and 2, a gauge assembly in accordance with the present invention comprises a cathode 12, anode 14, ion collector 16, and respective guard ring electrodes 18. If desired, gauge assembly 10 can be disposed within a suitable vacuum enclosure 20. Vacuum enclosure 20 is suitably formed of metal, or of glass having a conductive coating, such as, for example, a tin oxide, deposited on the inner surface thereof. Enclosure 20 is preferably maintained at ground potential. Alternatively, gauge assembly 10 may be utilized as a "nude" gauge with suitable vacuum containment being provided by a cooperating system, as is well-known in the art.

Cathode 12 comprises a thermionic electron emitter in the form of a thin, flat strip or ribbon. The flat strip is disposed with the emitting surface facing anode 14, along an arc of approximately 180° or less, generally concentric with the axis of gauge assembly 10. Respective support members (not shown) are disposed at each end of the arc to rigidly affix cathode 12 with respect to assembly 10. The disposition of cathode 12 relative to anode 14 is concentric, and will hereinafter be described in more detail in conjunction with FIGS. 7 and 8. Cathode 12 is suitably biased by a battery 13 (e.g., +30 v) with respect to vacuum enclosure 20 so that emitted electrons have insufficient energy to reach the grounded enclosure, as is well-known in the art. A suitable cathode heater power supply 30 provides a signal for heating cathode 12. An emission control circuit (not shown) is typically utilized to control cathode heater supply 30, to ensure constant emission. Such emission control circuit typically monitors total current in a control loop between cathode 12 and anode 14 and varies the cathode temperature accordingly.

The flat ribbon shape of cathode 12 provides great stability of cathode 12 with the gauge axis disposed either vertically or horizontally. If the no more than approximately 100° of arc of cathode is unsupported, and if the ribbon is carefully formed without wrinkles or other imperfections, cathode sag or creep is minimal, irrespective of the disposition of the gauge axis. Thus, cathode 12 is essentially self-supporting in any mounting position.

Anode 14, in accordance with the present invention, comprises a closed, cylindrically symmetric electrode defining an essentially closed internal volume 14*a*, and including a generally flat bottom plate 22, and a hemispherical dome-shaped top portion 24. Hemispherical dome-shaped portion 24 of anode 14 has a constant radius centered on the point of maximum curvature of the electron trajectory, e.g., where the electron stream crosses the axis of the anode, as will be more fully explained in conjunction with FIG. 4. An entrance slit 26 is formed in the wall of anode 14 in alignment with cathode 12. The width of entrance slit 26 is chosen to be as small as possible, while still permitting proper focusing of all emitted electrons from cathode 12 through the slit into interior anode volume 14*a*. As is well-known in the art, anode 14 is suitably biased by a battery 15 (e.g., +180 v) to accelerate electrons emitted from the cathode toward the anode.

Guard rings 18 are electrodes, suitably electrically connected to cathode 12, generally conforming to the shape of the anode 14 and disposed above and below cathode 12 to cooperate in generating electrostatic fields to focus all electrons emitted from cathode 12 through the anode entrance slit 26 into the interior anode volume 14*a*. The conditions for focusing can readily be determined utilizing known electromagnetic field theory. In this regard, reference is made to Spangenberg, *Vacuum Tubes,* McGraw Hill, New York, New York: 1948, Chapter 5, "Determination of Potential Fields." In particular, computer techniques for electron ray tracing, which are well-known in the design of electron microscopes, cathode ray tubes, image intensifiers, mass spectrometers, etc., may be utilized.

Figure 6:
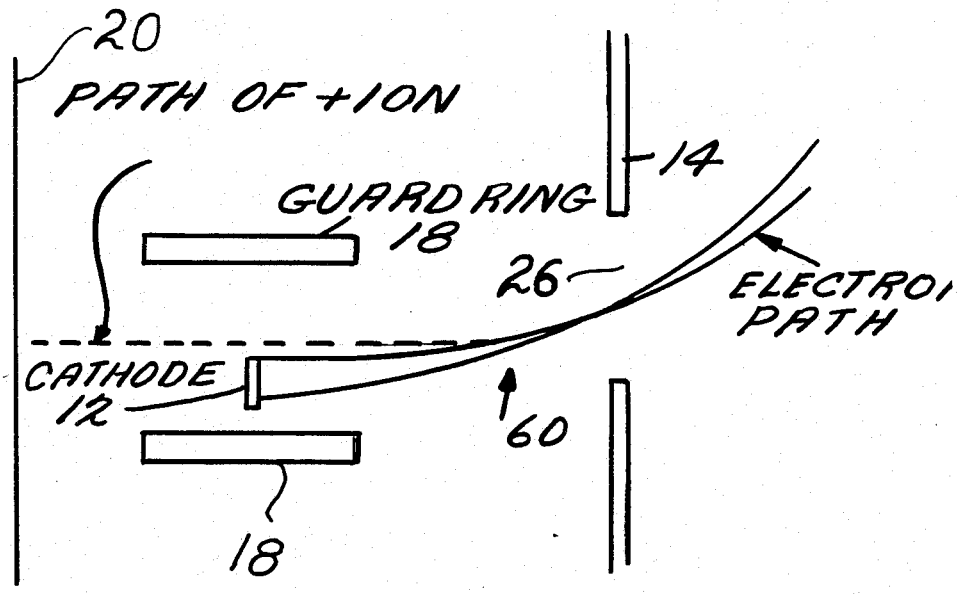
FIG. 6 is a schematic illustration of the relative disposition of the guard rings and cathode.

Guard rings 18 are preferably electrically connected to the midpoint of cathode 12, but may be connected to either end of the cathode, which will be explained. The disposition of the guard rings with respect to cathode 12 will hereinafter be more fully described in conjunction with FIG. 6.

Figure 11:
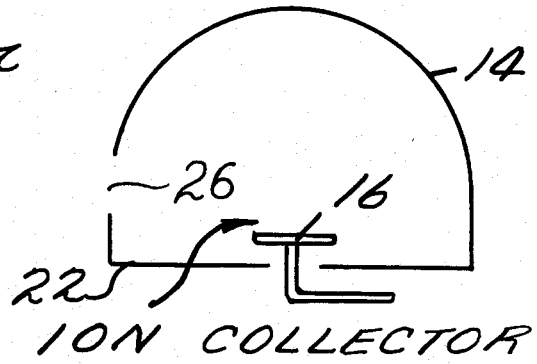
FIGS. 11 and 12 are a schematic side view and top view of a fine wire ion collector.
Figure 12:
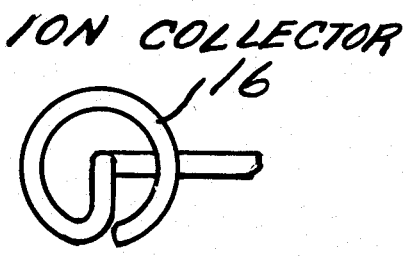

Ion collector 16 is an electrode having a relatively small area utilized for a number of functions: to collimate the electron stream from cathode 12 within anode volume 14*a;* to deflect the electron stream away from the ion collector electrode toward the dome-shaped upper portion 24 of anode 14; and to collect positive ions formed in the anode volume due to interaction with the electron stream. Ion collector 16 is suitably a circular disk, but may take other forms such as a ring or mesh, such as shown in FIGS. 11 and 12, or a straight wire (not shown). Ion collector 16 is suitably connected to ground potential by a lead passing through a small opening in bottom plate 22 of anode 14.

Ion collector 16 is suitably centrally disposed within and the surface generally parallel to anode bottom plate 22. However, ion collector 16 may be radially offset from bottom plate 22 or tilted, as will be explained in conjunction with FIGS. 9 and 10.

In operation, appropriate power is provided from cathode heater power supply 30 through respective leads passing into the vacuum enclosure 20 to cathode 12, causing thermionic emission of electrons. The electric fields produced by cathode 12, anode 14, guard rings 18, and vacuum enclosure 20 cooperate in generating electrostatic fields to focus essentially all emitted electrons through anode entrance slit 26 into the anode volume 14*a*.

As previously noted, the arc-shaped emitting surface of cathode 12 (and guard rings 18) is concentric with and partially encircles anode 14. Therefore, all portions of cathode 12 are equidistant from the anode 14. Thus, the electrostatic field between cathode 12 and anode 14 is cylindrically symmetric, and all electrons emitted from along a given axial position on cathode 12 travel essentially in the same trajectory between cathode and anode. Further, substantially the same electrostatic field is experienced by each electron emitted from the cathode at corresponding points in the respective trajectories thereof.

Figure 3:
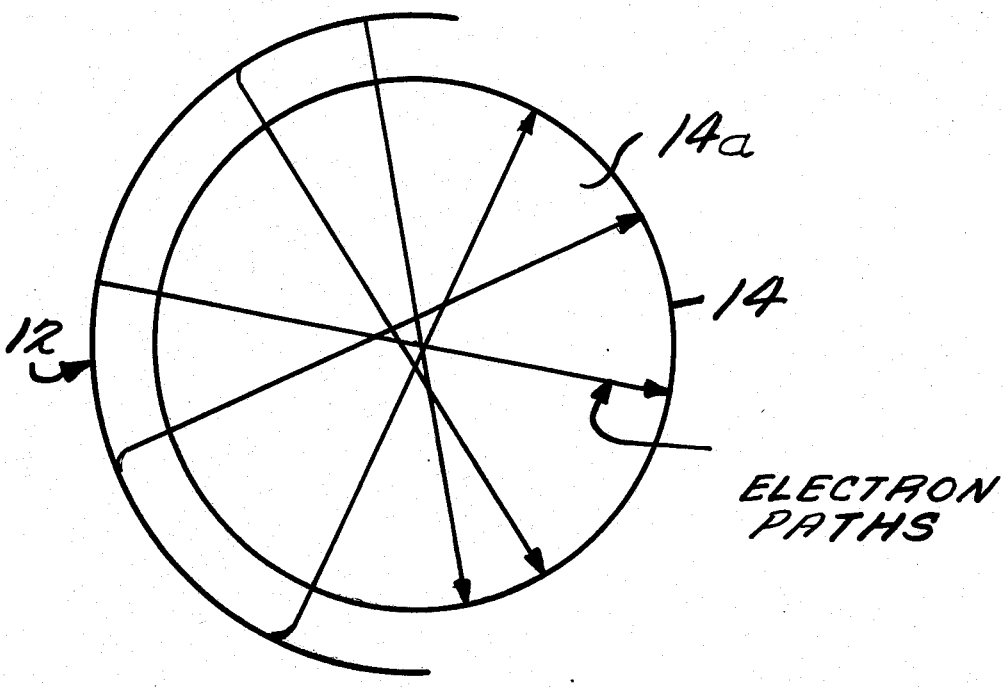
FIG. 3 is a schematic illustration of the electron trajectories in the gauge of the FIG. 1.

The electrons enter anode volume 14*a* through entrance slit 26, and travel essentially diametrically across anode volume 14*a* as shown schematically in FIG. 3. Some electrons are emitted with tangential velocities, and accordingly do not pass through the center of the anode. However, because anode volume 14*a* is closed, the electrons cannot exit the anode volume, and all electrons are collected on the inner surface of the anode, after a single traversal of the anode volume. Thus, all emitted electrons traverse the ion collection volume only once.

It is noted that the AC voltage provided by cathode heater 30 (FIG. 1) produces an instantaneous asymmetry in the electric field between the cathode and anode. However, such asymmetries average out over a cycle so that the average electric field between cathode and anode is purely radial except for very small axial focusing components. More specifically, the focusing field provided by, inter alia guard rings 18, to ensure that all emitted electrons enter anode volume 14*a* produces slight differences in the path lengths of electrons emitted from different axial positions on cathode 12. This effect is minimal for narrow cathodes and, as will be explained, is minimized for wider cathodes by the collimating effect of ion collector 16 and by the hemispherical shape of top portion 24 of anode 14.

Figure 4:
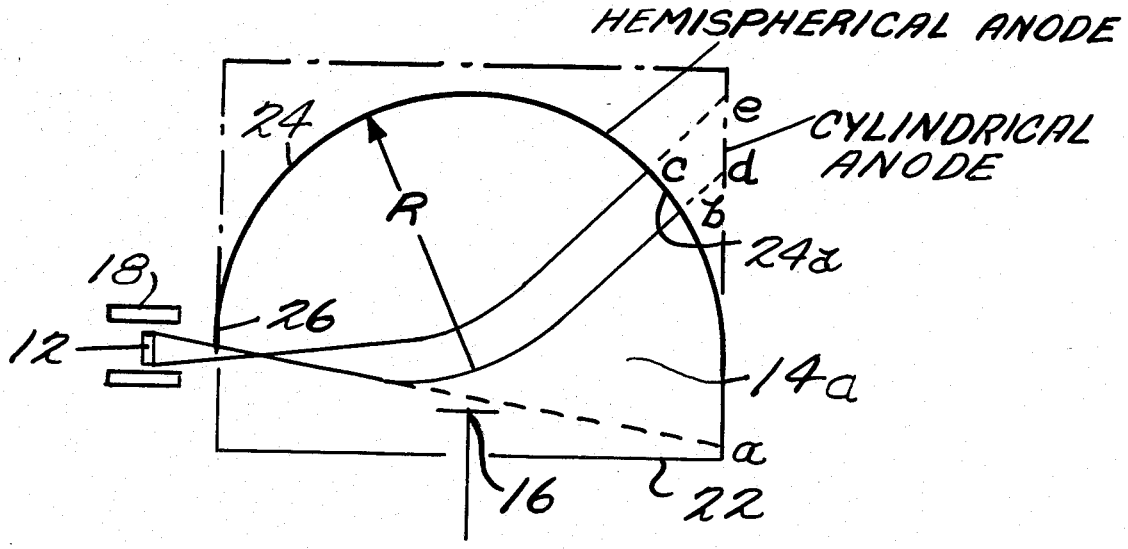
FIG. 4 is a schematic side view of the electron trajectories.

Referring now to FIG. 4, ion collector 16 is configured, disposed, and biased relative to anode 14, to deflect and collimate the electron stream upward in anode volume 14*a* (away from ion collector 16) so that the electrons impinge upon a particular "electron capture" region 24*a* of hemispherical dome surface 24. As previously noted, the hemispherical dome-shaped top portion 24 of anode 14 has a constant radius centered upon where the electron stream crosses the axis of the anode. Ion collector 16 is disposed such that the electric field in the anode volume tends to displace the electron beam upward from its initial trajectory so that the electrons follow a trajectory having a point of maximum curvature on the axis of the anode. For example, an electron beam which would have impinged at point "A" on the cylindrical anode is deflected upward by the electric field in the anode volume so that the electron, in fact, impinges on the anode at point "b". The hemispheric shape of top portion 24 of the anode provides for more uniform path lengths for the electrons. For example, the path length in the electrode volume for electrons impinging at points "b" and "c" on the hemispherical dome 24 are more nearly the same than for electrons which would impinge on points "d" and "e" on a purely cylindrical anode. Thus, the hemispherical dome 24 and ion collector 16 cooperate to provide constant path lengths for the electrons through the ion collection volume.

It should be noted that since the electron path length is essentially constant with respect to all emitting positions on cathode 12, changes in the emission pattern from the cathode have essentially no effect on the operation of gauge assembly 10. Also, because of the symmetry of the electric fields, all emitted electrons manifest nearly the same kinetic energy and ionizing ability at corresponding points in their trajectories. Accordingly, the cumulative total path length of all emitted electrons in the ion collection volume is independent of the point of origin of the electrons on the cathode. Therefore, the sensitivity of gauge assembly 10 is essentially unaffected by changes in the emission pattern of cathode 12.

Further, closed anode volume 14*a* provides a proportionately larger ion collection volume than do prior art gauges. No extraneous electromagnetic fields are permitted to leak into closed anode volume 14*a*. Accordingly, the ion collection volume in gauge assembly 10 is a relatively larger fraction of the anode volume. The larger ion collection volume diameter provided in gauge assembly 10 concomitantly provides a longer electron path length within the ion collection volume, thus increasing the ionizing ability of the electrons. In addition, because the ion collection volume is larger, more of the ions formed within the anode volume are collected by ion collector 16. Thus, gauge assembly 10 provides considerably higher sensitivity than does a prior art gauge having an equal anode volume.

It should also be noted that the ion collection volume in an essentially closed anode volume is readily and completely reproducible and stable as compared to the ion collection volumes in prior art grid-type gauges.

It should be appreciated that any cathode/anode/collector configuration that provides substantially the same electrostatic field in respect of each electron emitted from the cathode at corresponding points in the respective trajectories of the electrons can be utilized. For example, a straight cathode disposed parallel to the axis of a cylindrical anode, with guard rings disposed parallel to the cathode to focus electrons through an axial anode entrance slit (also disposed parallel to the anode axis) can be utilized in conjunction with one or more straight wire collectors disposed parallel to the anode axis, radially offset from the axis of the anode.

The straight wire collectors can be disposed to displace the electron beam sidewards (i.e., radially) such that electrons follow a trajectory having a point of maximum curvature on the axis of the anode. The electrons would thus suitably impinge on a curved portion of the cylindrical sidewall of the anode, rather than the hemispherical dome portion. Such an arrangement provides constant path lengths for the electrons through the collection volume.

To provide high sensitivity and accommodate measurement of high vacuum, it is also important that ion collector 16 not intercept large quantities of X-rays from the electron impingement region. Accordingly, ion collector 16 should be made relatively small in area to subtend as small a geometrical solid angle at the electron impingement region as possible. In this regard, see U.S. Pat. No. 4,307,323 issued Dec. 22, 1981 to Bills et al. However, if the ion collector area is made too small, then all ions which are formed will not be collected. For example, atomic ions formed from the ionization and disassociation of a diatomic molecule such as $N_2$ may have relatively large kinetic energy and, concomitantly, a large angular momentum about the ion collector. Accordingly, it is unlikely that an ion collector 16 having a very small area would collect such high energy ions. It has been found empirically that a 0.2 inch diameter collector operates satisfactorily, but that a 0.05 inch diameter, while providing a reduced X-ray limit, tends not to collect all ions formed. Accordingly, it is desirable to provide a reduction in X-ray limit without requiring further reduction in ion collector area.

Figure 9:
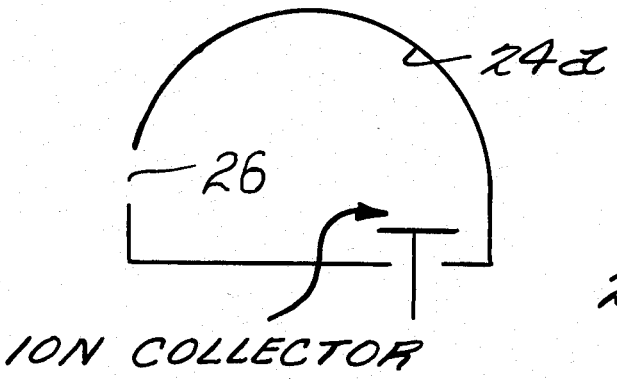
FIGS. 9 and 10 show alternative dispositions of the ion collector.
Figure 10:
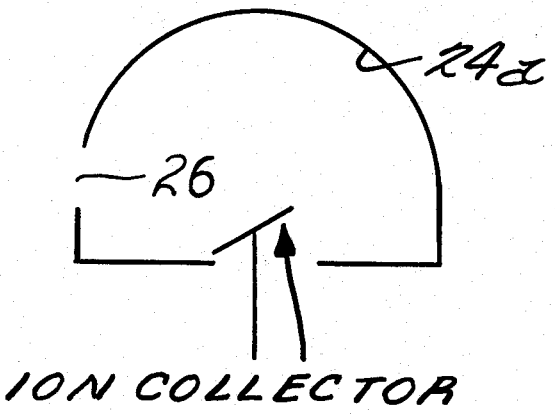

Incidence of X-rays can be reduced without reducing actual ion collector area, by disposing ion collector 16 to subtend a reduced area with respect to the region of anode 14 where the electrons are captured (i.e., the point of origin of the X-rays). Examples of such technique are shown schematically in FIGS. 9 and 10. Referring to FIG. 9, ion collector 16 is disposed off center in anode volume 14*a*. Because X-rays are emitted according to a cosine law, fewer X-rays will be incident on the ion collector and a lower pressure limit can be achieved. In addition, as shown in FIG. 10, ion collector 16 can be tilted with respect to bottom plate 22 of anode 14 in order to subtend a smaller angle with respect to electron capture region 24*a*.

Figure 5:
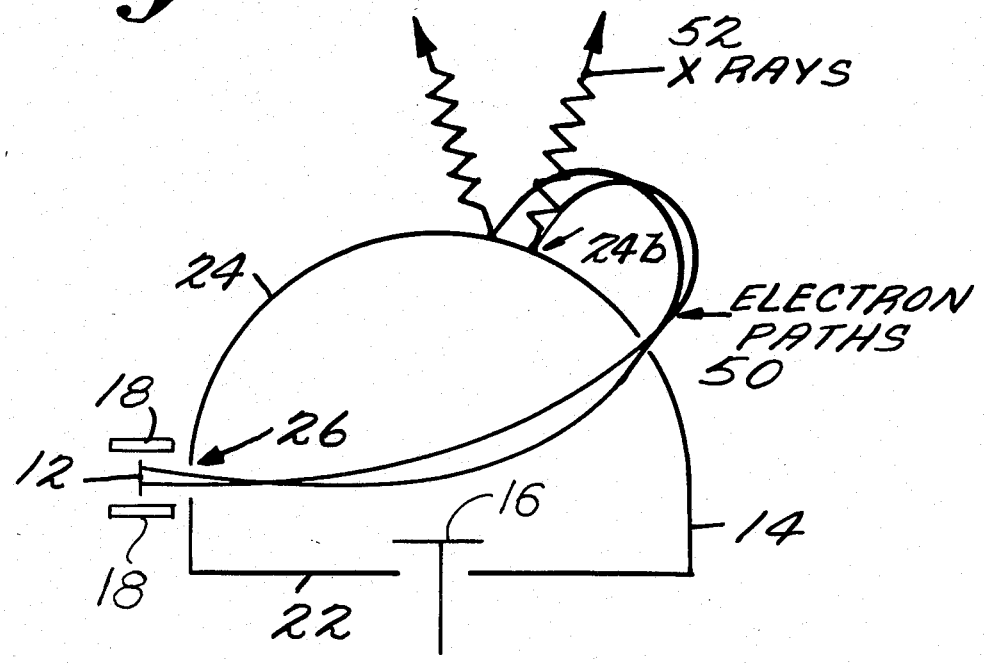
FIG. 5 is a schematic illustration of the relative disposition of the exit slit in the anode.

It is also possible to use an ion collector which is largely transparent so that fewer X-rays will be incident on the metal portion of the collector. X-rays passing through an open mesh in the collector will not contribute to X-ray current, and thus a lower pressure limit can be achieved than with a solid collector of the same area. A still smaller X-ray limit can be achieved by utilizing a fine wire ion collector such as shown in FIGS. 11 and 12. As best seen from FIG. 12, ion collector 16 comprises a fine wire bent into a generally annular configuration in a plane generally parallel to bottom plate 22 of anode 14. Such a fine wire ion collector electrode presents a very small exposed area for X-ray impingement, while still providing the necessary electron beam focusing conditions and ion collection conditions within anode volume 14*a*. Reduction of X-ray impingement on ion collector 16 can also be accomplished by causing all of the emitted electrons to enter the closed anode, but capture the electrons on a surface outside of the anode volume 14*a* to which ion collector 16 and its support are not exposed. An example of such a gauge structure is shown in FIG. 5. Specifically, an exit slit 50 is formed in the dome portion 24 of anode 14 at a position corresponding to capture region 24*a* of dome 24. When an additional electrode (e.g., the vacuum enclosure 20) is suitably positioned with respect to the anode and held at a suitable potential, the exciting electrons will be deflected and captured on a region 24*b* of the outside surface of the anode (to which ion collector 16 is not exposed). X-rays 52 produced at the outside surface of the anode are highly unlikely to be reflected so as to impinge on ion collector 16. Thus, the X-ray effect is substantially reduced by the use of a suitable exit slit, permitting measurement of lower pressures. The conditions for deflecting exciting electrons for collection on the outer electrode surface can be established in accordance with known electron ray tracing techniques (electromagnetic field theory). Computer techniques for electron ray tracing are well-known in the design of electron microscopes, cathode ray tubes, image intensifiers, mass spectrometers, etc. For further description of electron ray tracing techniques, reference is made to Spangenberg, *Vacuum Tubes,* supra.

As previously noted, the configuration and relative dispositions of cathode 12, anode 14, ion collector 16 and guard rings 18 provide a gauge of much higher sensitivity for given anode dimension than the prior art, and thus accommodate measurement of very low pressures. Moreover, the lower limit of measurement can be still further reduced by use of exit slit 50 in anode 14 to reduce the X-ray effect.

However, for some applications, such as sputtering, it is required to measure high pressure as well as low pressure. As previously noted, all emitted electrons in gauge assembly 10 travel the same distance from cathode to anode. This facilitates accuracy in measuring higher pressures. Measurements of high pressure can be further accommodated by positioning guard rings 18 so that positive ions which are formed in the cathode to anode space are preferentially attracted to the guard rings or the wall of vacuum enclosure 20. An example of such an assembly is shown schematically in FIG. 6. When a relatively high pressure of gas is present in enclosure 20, significant numbers of positive ions are formed in the space 60 between cathode 12 and entry slit 26 of anode 14. That is, the electrons emitted from cathode 12 react with a gas molecule and generate an ion prior to entering anode space 14*a*. The ions generated outside of the anode space are repelled by the anode and attracted to the cathode. The cathode collects the ions, and the ions contribute to the current in the cathode emission control circuit. Since the emission control circuit cannot distinguish between a positive ion arriving at the cathode and a negative ion emitted from the cathode, the emission control circuit (not shown) tends to reduce the cathode temperature to decrease the number of emitted electrons in order to maintain constant "emission".

Auxiliary electrodes having a potential lower than that of the cathode, disposed near the cathode so that a large fraction of the ions are attracted to the auxiliary electrode, have been proposed. See N. Ohsako, *Journal of Vacuum Science Technology,* 20 1153 (1982). The use of such an auxiliary electrode has extended the linearity range of a conventional BA gauge by at least an order of magnitude. However, the auxiliary electrode requires an additional feed through into the vacuum enclosure, and also requires an additional voltage supply.

In accordance with one aspect of the present invention, the effect of ions generated outside of anode volume 14*a* can be avoided by offsetting cathode 12 between guard rings 18 so that the electron stream manifests a sharp curvature along the path of the beam between cathode 12 and anode entry slit 26. Such sharp curvature in the electron path causes the majority of ions formed in space 60 to miss cathode 12 and be collected on the grounded wall of vacuum enclosure 20. Since fewer positive ions are collected on cathode 12, the emission current remains essentially constant with respect to higher pressures. The precise position of cathode 12 with respect to guard rings 18 is determined by application of conventional electrostatic field theory, suitably by computer techniques of electron ray tracing as is well-known in the art.

In addition, guard rings 18 may be placed at potentials different from cathode 12 to provide additional curvature of the electron stream passing through space 60. Such an arrangement, however, may require additional feed throughs into vacuum enclosure 20, and voltage supplies in addition to those commonly used.

In addition, it is desirable that the space 60 between cathode 12 and anode 14 be minimized. However, the spacing between cathode 12 and anode 14 is a parameter in the determination of the electrostatic fields, i.e., electron optics for properly collimating and focusing the electron beams through entrance slit 26.

It has been found that the use of guard rings 18 renders the electron optics of gauge assembly 10 relatively insensitive to variations in cathode position, and readily permits correct cathode positioning within ordinary manufacturing tolerances.

Figure 8:
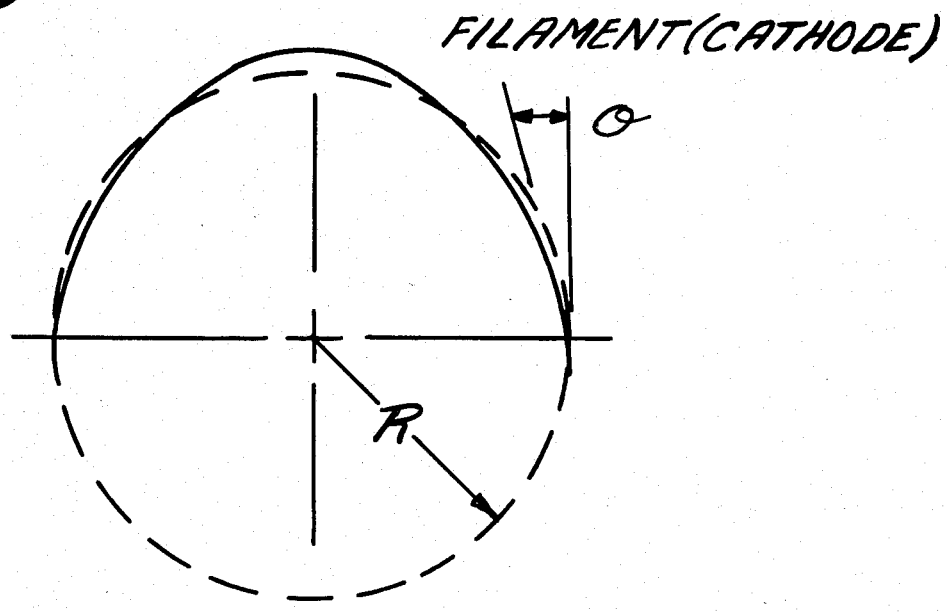
FIG. 8 is a schematic illustration of hot cathode geometry.
Figure 7:
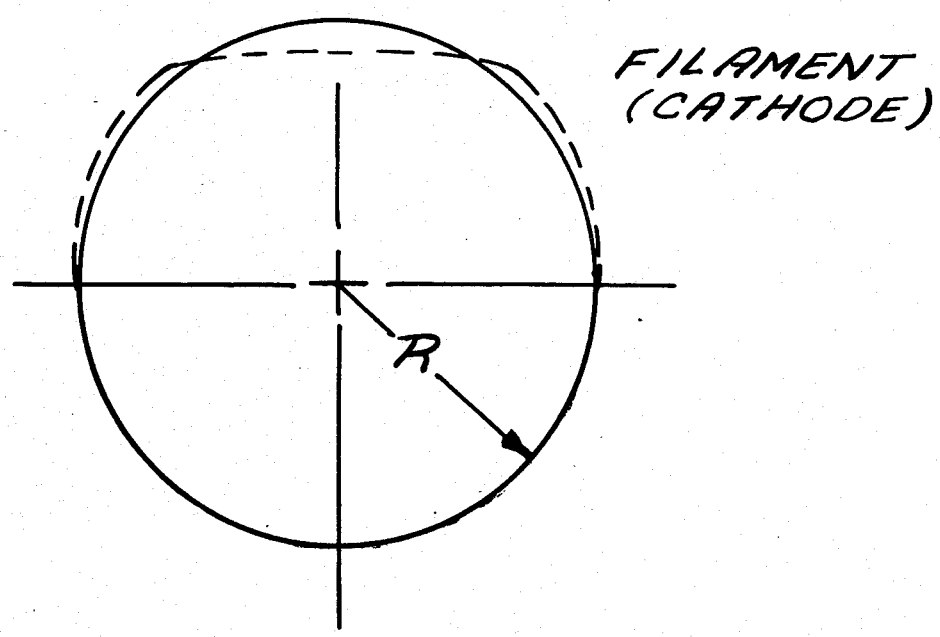
FIG. 7 is a schematic illustration of uncompensated cathode geometry.

Referring now to FIGS. 7 and 8, provisions for accommodating expansion of cathode 12 due to heating will be described. Because thermionic cathodes tend to expand considerably when heated, free-standing cathodes are preferred in ionization gauges. (No small, delicate, costly springs are required to accommodate thermal expansion of a free-standing cathode.) As previously mentioned, cathode 12 is in the form of a thin flat thermionic ribbon, concentric with and partially encircling cylindrically symmetric anode 14. All portions of the emitting surface of cathode 12 are equidistant from anode 14 to thus provide a circumferentially symmetric electric field between cathode 12 and anode 14. The desired disposition of the emitting surface of cathode 12 at a radius "R" concentric with anode 14 is illustrated in solid line in FIG. 7. However, it must be appreciated that thermal expansion of the cathode 12 when heated into an emitting state causes distortion and displacement of portions of the cathode. More specifically, when cathode 12 is heated, the support structures (not shown) at the ends of cathode 12 act as heat sinks, and the central portion of cathode 12 becomes much hotter than the ends in the vicinity of the cathode supports. Accordingly, the central portion loses much of its stiffness. The ends, being cooler and stiffer, tend to expand outwardly due to residual stresses as the center portion of cathode 12 becomes less stiff. Cathode 12, when heated, will thus assume a shape such as shown (in exaggerated form) in dotted line in FIG. 7. Thus, if cathode 12 is mounted when cold along the desired arc (shown in solid line), when heated, thermal expansion will cause cathode 12 to distort and move out of the correct position.

Accordingly, to compensate for thermal expansion, cathode 12 is predistorted when mounted cold as shown in solid line in FIG. 8. Specifically, when mounted cold, the ends of cathode 12 are disposed inwardly of the desired arc, displaced from the tangent to the arc by a predetermined angle $\theta$ as shown in solid line in FIG. 8. When cathode 12 is heated, the ends of the cathode move outwardly, and cathode 12 assumes the desired arc (shown in dotted line in FIG. 8). The angle $\theta$ by which the ends of cold anode 12 is offset from the tangent depends upon the width, thickness and material properties of the cathode ribbon. For an iridium ribbon 0.002-inch thick by 0.027-inch wide, the angle $\theta$ between the tangent and the cold ribbon cathode is approximately 7°.

It should be appreciated that the present invention provides a particularly advantageous ionization gauge. As previously noted, the electric fields produced by cathode 12, anode 14, guard rings 18, and vacuum enclosure 20 focus essentially all of the electrons emitted from cathode 12 through the anode entrance slit 26 into the anode volume. Thus, all emitted electrons are available for producing ionization in the anode volume. In the prior art gauges, as much as 50% of the emitted electrons never enter the anode volume, and are thus not available for producing ionization. Further, since the anode volume is relatively closed, the ion collection volume is a relatively large fraction of the anode volume, as compared to the prior art gauges. Thus, for a given anode diameter, gauge assembly 10 provides a greater ion collection volume. Accordingly, the electron path length within the ion collection volume is longer, increasing the likelihood of ionization, and, additionally, more of the ions formed within the anode are collected by the ion collector. Thus, a higher sensitivity is provided. Also, since cathode 12 and anode 14 are concentric with all portions of cathode 12 equidistant from anode 14, and, particularly, since ion collector 16 deflects the electrons to impinge upon the dome-shaped upper portion 24 of anode 14, all electrons manifest essentially the same trajectory, path length, and ionizing ability. Thus, the sensitivity of gauge assembly 10 is essentially unaffected by changes in the emission pattern of the cathode. Further, since the ion collection volume is a relatively large fraction of the anode volume, the present invention provides a high sensitivity, low pressure transducer for the very small internal volume.

The nearly constant path length provided for all electrons in the closed anode volume of the gauge 10 is to be contrasted with the greatly different electron paths through the anode volume manifested in prior art gauges. In prior art gauges utilizing a fine wire ion collector on the axis of the anode, electron paths in the anode volume can differ by almost an order of magnitude. See P. A. Redhead, *J. Vac. Sci. Technol.*, 6 848 (1969).

Also, gauge 10 is relatively insensitive to variations in cathode position. This is to be contrasted with the extreme criticality of cathode position in the prior art gauges. It has been found that variations in sensitivity of 50% or more are produced by cathode positioning error of only a few thousandths of an inch in the prior art. Moreover, the thin ribbon cathode 12 exhibits minimal sag or creep, whereas prior art free-standing cathodes in ionization gauges have been found to creep and sag badly with extended use at typical operating temperatures.

Ionization gauge 10 is also advantageous in that the ion collection efficiency is increased over prior art gauges utilizing open grids. Open grids provide opportunities for energetic ions to escape collection by the ion collector. Escape of ions tends to decrease sensitivity of a gauge. In diatomic gases such as $N_2$, as much as 20% of the ions generated have sufficient energy to escape through the open grid electrodes commonly used in prior art gauges.

Further, gauge assembly 10 is also particularly advantageous in that it is essentially insensitive to existing electric fields and energetic particles in the vacuum system. The disposition of cathode 12 between guard rings 18, and the use of a closed anode 14, effectively shields gauge assembly 10 from disturbing electric fields in the vacuum system within which gauge assembly 10 is used, as well as energetic particles such as ions and electrons which are often present in vacuum systems used in, for example, plasma work, sputtering, or electron beam evaporation. The open gridded structure of the prior art gauges, on the other hand, are extremely sensitive to vacuum system environment.

It will be understood that while various of the conductors/connections are shown on the drawing as single lines, they are not so shown in a limiting sense and may comprise plural connections as is understood in the art. Further, the above description is of preferred exemplary embodiments of the present invention, and the invention is not limited to the specific forms shown. Modifications may be made in the design and arrangement of the elements without departing from the spirit of the invention as expressed in the appended claims.

What is claimed is:

1. In an ionization gauge of the type including a source of electrons having an electron emitting surface, an accelerating electrode for accelerating said electrons through a volume generally defined by said accelerating electrode, and a collector electrode, disposed in said volume, for collecting ions formed by interaction between said electrons and gas within said volume, the improvement wherein:

said accelerating electrode comprises a substantially closed anode having an internal cavity to precisely define said volume, and an aperture disposed to admit substantially all of said electrons from said source into said closed anode volume; and electric field producing means for providing with respect to each of said electrons in said volume substantially the same electrostatic field at corresponding points in the respective trajectories of the electrons;

whereby the sensitivity of said ionization gauge is substantially independent of variations in the electron emission pattern over the electron emitting surface of said electron source.

2. In the gauge of claim 1, the further improvement wherein said anode is cylindrically symmetrical, said aperture comprises an entry slit, and said source of electrons comprises a thermionic cathode having an arc-shaped emitting surface concentrically disposed with said anode.

3. In the gauge of claim 2, the further improvement wherein said cathode comprises a ribbon of thermionic material having a flat emitting surface, disposed with said flat emitting surface facing said anode.

4. In the gauge of claim 1, the further improvement wherein said anode includes a hemispherical top portion having a predetermined center of curvature.

5. In the gauge of claim 4, the further improvement wherein said ion collector is adapted to repel said electrons such that said electrons traverse a curved path through said volume, said path having a point of maximum curvature approximately at the center of curvature of said hemispherical top portion.

6. In the gauge of claim 2, the further improvement wherein said anode includes a hemispherical top portion having a predetermined center of curvature.

7. In the gauge of claim 6, the further improvement wherein said ion collector is adapted to repel said electrons such that said electrons traverse a curved path through said volume, said path having a point of maximum curvature approximately at the center of curvature of said hemispherical top portion.

8. In the gauge of claim 1, the further improvement wherein said gauge further comprises means for focusing said electrons through said anode aperture.

9. In the gauge of claim 2, the further improvement wherein said gauge further comprises means for focusing said electrons through said anode entry slit.

10. In the gauge of claim 9, the further improvement wherein said means for focusing comprises respective guard electrodes, having arc-shaped portions disposed axially above and below said cathode arc-shaped emitting surface.

11. The gauge of claim 10, wherein said guard electrodes are electrically coupled to said cathode.

12. The gauge of claim 1, wherein said anode includes an escape aperture disposed to release electrons from said volume; and said gauge further comprises means for deflecting said released electrons for capture by the outer surface of said anode.

13. An ionization gauge comprising:

a supporting structure;

a thermionic cathode for emitting electrons, rigidly connected to said support structure;

a generally cylindrically symmetrical anode, rigidly connected to said supporting structure, said anode defining a substantially closed anode volume in the interior thereof, and including a slit-shaped aperture disposed to admit said emitted electrons into said closed volume;

said cathode comprising a strip of thermionic material having a generally flat emitting surface disposed external to said closed volume with said emitting surface facing said anode aperture along an arc concentric with said anode such that all points on said emitting surface are essentially equidistant from said anode; and a collector electrode disposed within said closed volume for collecting ions generated within said closed volume by said electrons.

14. The gauge of claim 13 wherein said anode includes a generally dome-shaped top portion, having a predetermined center of curvature; and said gauge includes means for defining a predetermined point of maximum curvature in the paths traversed by said electrons through said closed volume approximately at said predetermined center of curvature.

15. The gauge of claim 14 further including electrostatic means for collimating said emitted electrons and directing substantially all of said electrons through said anode aperture.

16. The gauge of claim 15 wherein said means for collimating comprise respective guard electrodes disposed axially offset from the respective sides of said cathode along said arc.

17. The gauge of claim 16 wherein said guard electrodes are electrically connected with said cathode.

18. A method of providing stable and reproducible sensitivity of an ionization gauge of the type including a cathode for providing electrons, an anode for accelerating said electrons through a predetermined volume, and a collector electrode disposed in said volume for collecting ions formed in said volume, comprising the step of:

disposing said cathode and said anode such that the electron path length from said cathode through said volume is essentially independent of the point of origin of said electron on said cathode.

19. The method of claim 18 further including the step of:

generating an electric field between said cathode and said anode that is cylindrically symmetric.

20. The method of claim 18 further comprising the step of:

defining a closed volume within said anode; and forming an entry aperture in said anode disposed to receive substantially all of said electrons from said cathode.

21. The method of claim 18 further including the step of configuring said anode to have cylindrical symmetry; and wherein said disposing step includes the step of disposing the emitting surface of said cathode along an arc concentric with said anode.

22. In the gauge of claim 2, the further improvement wherein said cathode comprises a ribbon of thermionic material having an emitting surface, all portions of said emitting surface being disposed equidistant from said anode.

23. In the ionization gauge of claim 1, the further improvement wherein said source of electrons comprises a thermionic cathode having an electron emitting surface, all portions of said electron emitting surface being disposed equidistant from said anode.

24. In the ionization gauge of the type including a cathode for emitting electrons, an accelerating electrode for accelerating said electrons through a volume generally defined by said accelerating electrode, and a collector electrode, disposed in said volume, for collecting ions formed by interaction between said electrons and gas within said volume, the improvement wherein:

said accelerating electrode and said cathode are disposed to provide substantially the same electrostatic field in respect of each electron emitted from said cathode at corresponding points in the respective trajectories of said electrons.

25. In the ionization gauge of claim 24, further improvement wherein said accelerating electrode comprises a substantially closed anode having an internal cavity to precisely define said volume, and an aperture disposed to admit substantially all of said electrons emitted from said cathode into said volume, said collector electrode being disposed within said anode cavity.

26. In the ionization gauge of claim 24, the further improvement wherein said cathode includes an electron emitting surface, disposed such that all portions of said electron emitting surface are equidistant from said accelerating electrode.

27. In the ionization gauge of claim 24, the further improvement wherein said gauge includes means for establishing substantially the same electron path length from said cathode through said volume with respect to all electrons emitted by said cathode entering said volume.

28. In the gauge of claim 26, the further improvement wherein said cathode comprises a ribbon of thermionic material having a flat emitting surface, disposed with said flat emitting surface facing said anode.

29. In the ionization gauge of claim 24 wherein said accelerating electrode is a cylindrically symmetrical anode.

30. In the gauge of claim 29, the further improvement wherein said ion collector is adapted to repel said electrons such that said electrons traverse a curved path through said volume, said path having a point of maximum curvature approximately at the axis of said anode.

31. In the gauge of claim 25, the further improvement wherein said gauge further comprises means for focusing said electrons through said anode entry slit.

32. An ionization gauge comprising:

confinement means for establishing an ion collection volume;

a source of electrons having an electron emitting surface;

focusing means for directing substantially all of said electrons into said ion collection volume;

electric field producing means for providing with respect to each of said electrons in said ion collection volume substantially the same electrostatic field at corresponding points in the respective trajectories of the electrons; and means for collecting ions formed by interaction between said electrons and gas within said volume;

whereby the sensitivity of said ionization gauge is substantially independent of variations in the electron emission pattern over the electron emitting surface of said electron source.

33. An ionization gauge as in claim 32 where said electric field producing means includes at least said electron source and said confinement means.

34. An ionization gauge as in claim 32 where said electric field producing means further includes said ion collecting means.

35. A gauge as in claim 34 where said electron source, said confinement means, and said ion collecting means each constitute an electrode and where said focusing means is electrically connected to said electron source such that only the above said three electrodes are utilized in the gauge.

36. An ionization gauge as in claim 32 where the ion collection means collects a substantially constant proportion of the ions formed by said interaction between the electrons and the gas.

37. A gauge as in claim 36 where said ion collection means collects substantially all of said ions.

38. A gauge as in claim 32 where said confinement means has an aperture therein for receiving said electrons into said ion collection volume.

39. A gauge as in claim 38 where ions are formed outside said confinement means and said electron source is assymetrically disposed with respect to said focusing means to reduce the number of the latter ions collected at the electron source.

40. A gauge as in claim 39 where said electron source comprises an elongate member and said focusing means comprises a pair of elongate electrodes, said electron source being disposed between said focusing electrodes and closer to one of the electrodes than the other.

41. A gauge as in claim 32 where the number of transverses of each of said electrons across said ion collection volume is constant.

42. A gauge as in claim 41 where said number of transverses for each of said electrons is one.

43. The gauge of claim 32 wherein said gauge has an axis of symmetry and at least said electron source and said confinement means are symmetrically disposed with respect to said axis of symmetry.

44. The gauge of claim 43 where said ion collection means is also symmetrically disposed with respect to said axis of symmetry.

* * * * *